United States Patent [19]

Holland et al.

[11] 4,064,997

[45] Dec. 27, 1977

[54] CRANE SWING SAFETY CONTROL

[76] Inventors: Eugene Richard Holland, 121 S. Reese Place, Burbank, Calif. 91506; Melvin Glynn Schlieman, Murphys, Calif. 95247

[21] Appl. No.: 671,567

[22] Filed: Mar. 29, 1976

[51] Int. Cl.[2] ..... B66C 13/48

[52] U.S. Cl. ..... 212/39 B; 212/39 P; 340/267 C

[58] Field of Search ..... 212/39; 340/267 C; 254/187 G; 188/170

[56] References Cited

U.S. PATENT DOCUMENTS

| | | | |
|---|---|---|---|
| 3,253,683 | 5/1966 | Stein | 254/183 |
| 3,285,430 | 11/1966 | Whitmire | 212/39 R |
| 3,650,568 | 3/1972 | Poplawski | 188/170 |
| 3,756,665 | 9/1973 | Ryan | 303/81 |
| 3,833,898 | 9/1974 | Wilkinson | 212/39 P |

*Primary Examiner*—Lawrence J. Oresky
*Attorney, Agent, or Firm*—William H. Pavitt, Jr.

[57] ABSTRACT

A system to prevent a crane turret and the boom carried thereby from rotating about the axis of the turret beyond a predetermined angular disposition, thereby to prevent the crane boom from being brought too close to high-tension wires or some other structure in the vicinity of which the crane is being operated. Means are provided for locked-in disposition at at least one, and preferably, two points about the 360° arc circumscribing the turret with such means including projections adapted to trip limit switches extending radially outwardly from the rotatable turret. Each limit switch is connected into an electromagnetic circuit with the first switch to be tripped serving to actuate an audio and/or visual warning system, and the second switch to be tripped, an electromagnetic control of the fluid flow in a hydraulic or compressed air driving system. Such electromagnetic control overrides any manual control in the operator's cab of the hydraulic or air cylinder which releases or locks the brake band about the fixed post coaxial with the turret drum and about which the turret drum rotates. When such override occurs, the brake band is tightened to prevent further relative angular movement between the turret and the fixed post. Additionally, inductive means may be provided on the boom to detect undesirable proximity of the boom to high-tension lines and with such detection also to operate first, said warning device and then, the hydraulic or air cylinder override, thereby to prevent further angular rotation of the turret relative to said post.

10 Claims, 7 Drawing Figures

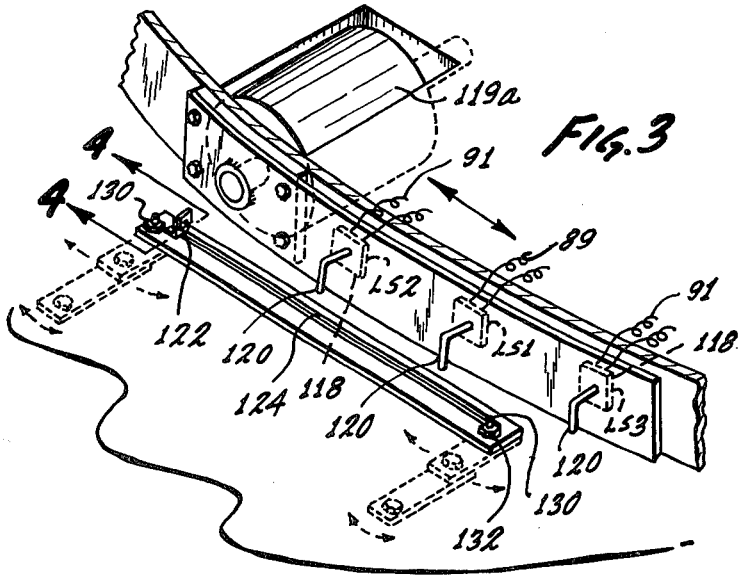
FIG. 3
FIG. 4
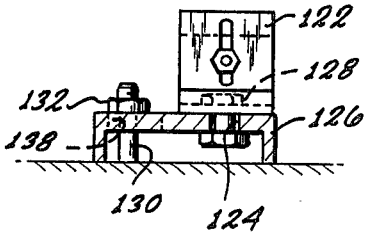
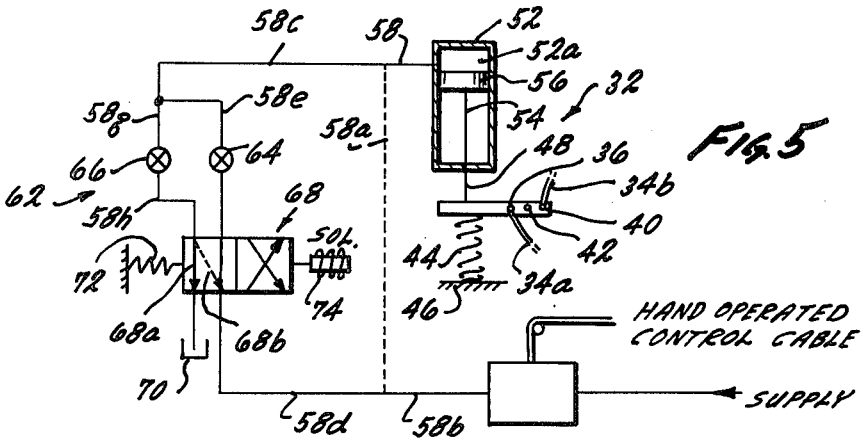
FIG. 5
FIG. 6
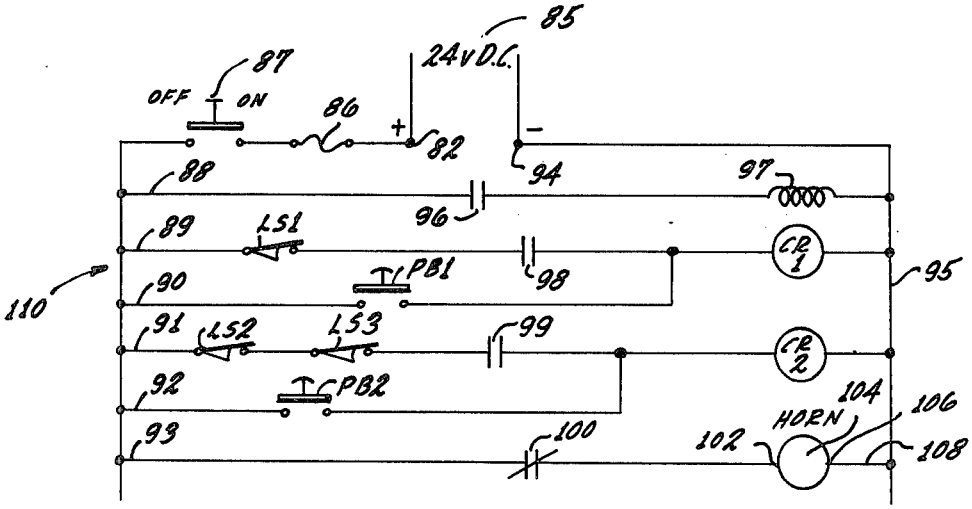

26'
150
150
152
AMP.
154
156
154'
156'
158
160
162
164
TO HORN CIRCUIT
TO SOL. CIRCUIT

CRANE SWING SAFETY CONTROL

BACKGROUND OF THE INVENTION

1. Field Of The Invention

This invention relates to boom carrying cranes which are usually mounted upon a mobile type of wheeled platform or truck bed for rotation about a fixed axis extending vertically through said platform or truck bed.

2. Description Of The Prior Art

In recent decades, increasing use has been made at demolition and construction sites of large mobile cranes which may be mounted upon a truck bed or other type of wheeled platform. These cranes may include a turret capped by a cab in which the operator may be seated, and from which turret and/or cab there may extend upwardly at an angle a crane boom supported at a preselected and changeable angle by a plurality of cables, usually extending from the turret, cab or another boom, to one or more points on the main boom. Such a crane is driven or rolled into a selected position at a building demolition or construction site where it may be secured against undesired lateral movement by a drop-down leg or other fixed device. Since, in many uses of such cranes, the boom may be operated either near high tension wires posing a great hazard to the crane operator, or near buildings or other structures which it is not desirable to have the crane boom strike in the course of its use at the site, a number of different means have been devised to prevent the crane operator from inadvertently allowing his crane boom to be swung too close to any proximate power lines or structures.

Among such prior art means have been disclosed in the following United States Pat. Nos.

R. G. Ely — 3,456,810

T. W. Thomas — 3,447,692

Orendorff — 3,664,515.

In these prior art patents the approach has generally been to provide a power cutoff for the driving means with or without some type of stop member which serves to prevent further rotation of the turret. Interposing any type of stop member, however, against which the heavy revolving turret will strike in order to block further rotation can result in producing a considerable jarring of the cab to the discomfort of the operator and, moreover, can result in damage to the parts of the crane which are involved with the turret rotation and its stoppage. In addition, where the effort has been to shut down the drive means by which turret rotation is effected, it is usually necessary to have the limiting means built into the crane turret driving system at the factory at the time the crane is being constructed. Such a system, therefore, does not readily lend itself to being later adapted to cranes previously built and which have been in operation without any such drive cutoff and/or blocking system.

The principal method which has been utilized to prevent crane booms from overswinging to strike power lines or other structures where the cranes have not been equipped with any prior art systems of the types disclosed in the patents cited above, has been to provide a heavy cable to extend laterally from the upper portion of the crane boom in a direction opposite from the power lines or other structures which are not to be struck, and to anchor this cable on a caterpillar tractor of sufficient size that it will effectively limit the lateral movement of the crane boom toward the power lines or other structures when the cable connecting the boom and the tractor is made taut. While this method of limiting the swing of the crane boom may be effective in some situations, it is wastefully expensive in that it ties up the construction company's tractor and prevents it from being otherwise employed at the building or demolition site, and further requires the presence of a high-priced tractor operator on the tractor itself. Moreover, in the case of the very large cranes with huge booms, there may be very few, if any, tractors which are of sufficient weight to stop the heavy boom from over swinging; i.e., the boom may be of such a total weight that if it acquires any inertia, it may actually pull the tractor from its stopped position toward the power lines or structures which are to be avoided.

The prior art has not, therefore, provided effective means for preventing crane boom overswings, particularly with respect to older existing cranes into which limiting systems of the prior art patents have not been built into their respective driving means.

SUMMARY OF THE PRESENT INVENTION

The present invention provides effective means for limiting the rotation of the crane turret (and the boom carried thereby) about the fixed centerpost about which the turret, in the absence of restraint, may be driven in rotation. The approach made by the present invention is through the rotational braking system. In many types of cranes, a brake band is wrapped about the fixed post and it is attached to the turret at its extremities through a hydraulically or compressed air actuated pivotable lever. This lever is maintained in a normally locked first position by a spring element. In this position the brake band is tightened about the fixed post, thereby to prevent relative rotation between the turret and the post. The lever, however, is pivotable from its said first position to a second position in which the spring is compressed and, in this second position, the brake band is loosened from about the fixed post to the extent that the turret may rotate freely about said post. The lever is moved into this second position by the action of the piston in a hydraulic or compressed air actuated cylinder when hydraulic fluid or air is forced into said cylinder behind the piston. A supply of hydraulic fluid or air under pressure may be provided by a pump driven by the crane engine. A lever or pushbutton control in the cab enables the operator to actuate the cylinder thereby to release the brake so that the turret may revolve about the fixed post in response to the crane's driving motor system. For convenience, the present invention will hereinafter be described with reference to a hydraulically operated crane. It should be understood, however, that the principles of the present invention would be equally applicable to control a crane operated by compressed air, and all references in this specification and the claims which follow, to the term "hydraulic" shall be deemed also to include compressed air operated cylinders and devices.

According to the present invention, an electrically operated solenoid is provided to operate a valve which may override the manual brake control in the cab to both cut off further supply of hydraulic fluid to the hydraulic brake cylinder, as well as bleed from the latter any buildup of hydraulic pressure theretofore developed in that cylinder by fluid which has reached the cylinder from the supply pump in response to manual operation of the brake control lever by the operator in the cab. When such overriding occurs and the hydraulic cylinder is emptied, the piston in the cylinder may be forced back by the brake locking spring to dispose the brake band lever in its first position. In this first position, as heretofore mentioned, the brake band is tightened about the fixed post to prevent further relative rotation between the turret and the fixed post. The solenoid which accomplishes this override may be triggered by limit switches disposed about the periphery of the turret and which may be tripped by projections disposed on the platform on which the turret rotates. Such projections may be placed at preselected locations on such platform to provide the desired rotational angular limit or limits. However, in order to enable the system to provide the desired overriding of the manual control of the turret rotating brakes, the control solenoid must first be activated by the operator's pressing a switch button which connects the brake control solenoid to a source of power to energize the same. In this posture, any cut-off of power to the solenoid, whether through power failure altogether, a break in the electrical line or switch, or an intended tripping of a limit switch by a projection on the turret, will result in the de-energization of the solenoid and consequent braking of the turret to prevent its further rotation about the fixed post. The system, thus, may be characterized as self-analyzing.

It is also a feature of this invention to provide in conjunction with the actual brake locking limit switch, one or more other switches disposed near such locking limit switch, which other switches, upon being tripped or triggered, turn on an audio or visual warning to the cab operator thus indicating to him that his turret is approaching its limit of permissible rotation. Such other switches are also arranged in circuit with the warning device in such manner that, when tripped, they break the circuit which, while closed, prevents the audio and/or visual warning from issuing.

It is a further feature of the present invention to dispose a plurality of electromagnetic detecting means in the boom. Such means are adapted to detect a low radio frequency field of a certain intensity, such as will be present in the vicinity of high-tension wires. Upon such a predetermined field intensity being detected by such means, signals may be generated first to trigger the audio or visual warning to the cab operator, and then to actuate the solenoid which produces the manual brake control override which is otherwise accomplished by the tripping or triggering of the limit switches on the periphery of the turret in accordance with the other feature of the present invention.

The principles of the present invention may also be applied to limit the movement of the crane boom vertically as well as horizontally.

BRIEF DESCRIPTION OF THE DRAWINGS

In the accompanying drawings:

FIG. 3 is an enlarged perspective view of a portion of the turret on which limit switches are disposed, and of that part of the crane platform carrying the switch tripping means;

FIG. 4 is an enlarged section taken on the lines 4—4 of FIG. 3 and looking in the direction of the arrows;

FIG. 5 is a schematic diagram of an override system of the present invention;

FIG. 6 is a schematic diagram of an electrical switching arrangement to be utilized in the present invention.

DESCRIPTION OF THE PREFERRED EMBODIMENTS

Figure 1:
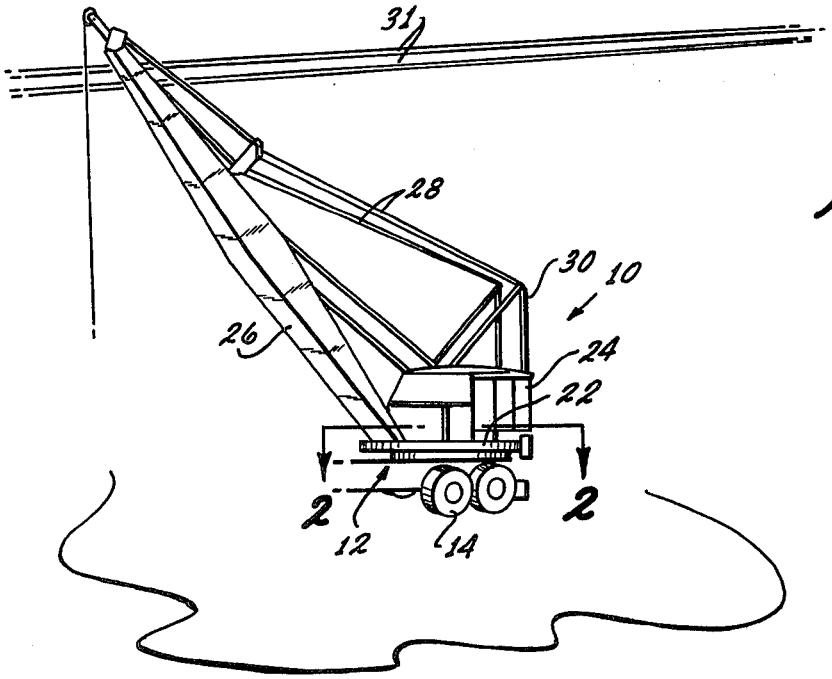
FIG. 1 is a perspective view of a typical crane being operated in the vicinity of high-tension lines.

Referring to FIG. 1, a mobile crane, designated generally as 10, comprises a bed or platform 12 carried by wheels 14 on which is mounted for rotation about a fixed post 16 (FIG. 2), a revolving turret 18. An annular plate 20 may be mounted on the top of the platform 12 to circumscribe the rotatable turret 18. Since the present invention is not concerned with the actual drive system employed for causing the turret 18 to rotate about the post 16, such drive system is neither illustrated nor discussed in this specification. The rotating turret 18 may be provided with a capping platform 22 on which the crane cab 24 may be mounted. A boom 26 may extend upwardly and at an angle from the turret 18 itself and/or from its platform 22. The angle which the boom 26 makes with respect to the horizontal platform 22, may be varied by driving means (not shown) which operate through a plurality of cables 28 and further booms 30.

Figure 2:
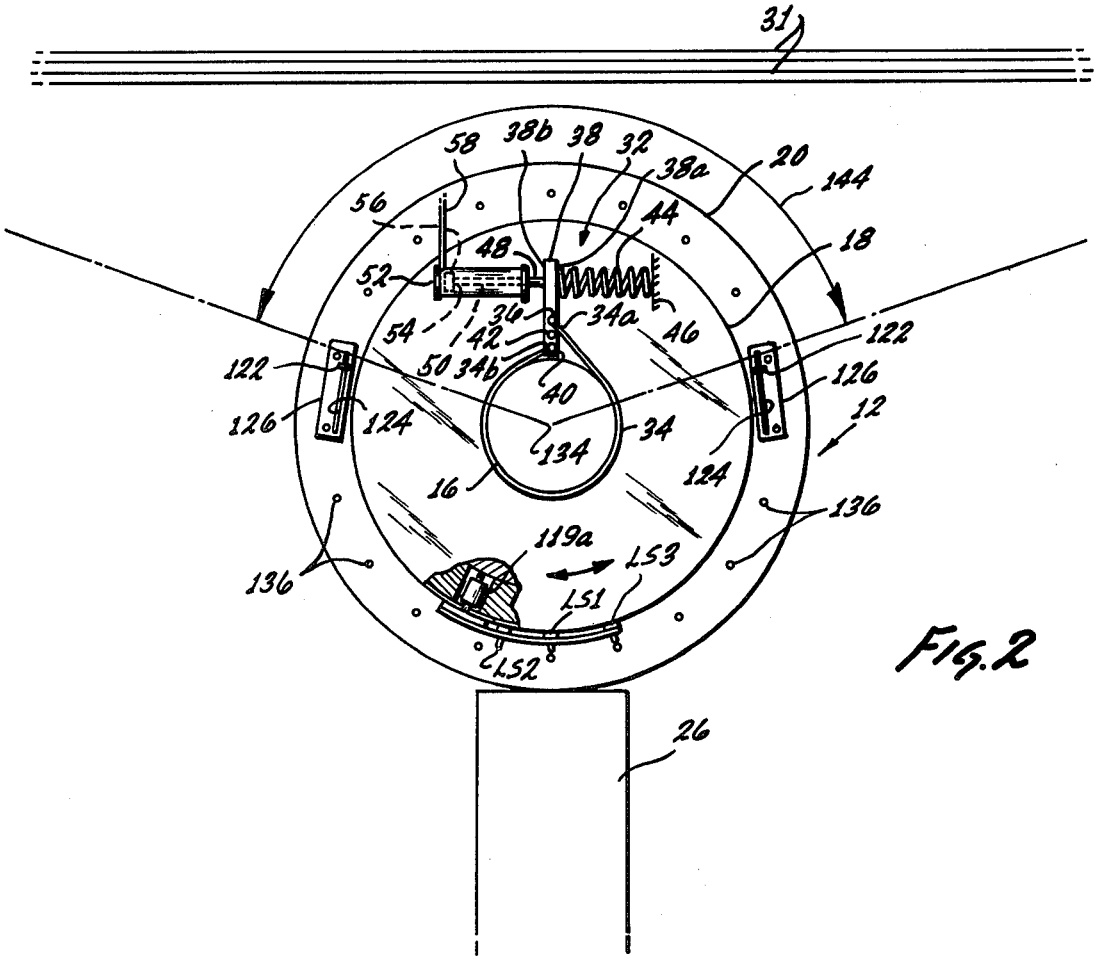
FIG. 2 is an enlarged section of the turret and part of the crane boom taken on the line 2—2 of FIG. 1 and looking in the direction of the arrows.

As may be best seen from FIG. 2, in certain types of cranes a braking system 32 is provided, the essence of which system is illustrated somewhat schematically in FIG. 2. Such a braking system might comprise a brake band 34 which almost completely encircles the fixed post 16. One end 34*a* of this brake band is secured rotatably about a point 36 on a lever 38; the other end 34*b* of the brake band 34 may be rotatably secured about a point 40 on the lever 38. This lever 38 is pivotably secured at a point 42 intermediate points 36 and 40 to the turret 18. The lever 38 is maintained in its first position shown in FIG. 2 by the force of the spring 44 which extends between the right side 38*a* of the lever 38 and a fixed area 46. The left side 38*b* of the lever 38 has attached thereto one end 48 of a plunger 50 extending from a hydraulic cylinder 52, desirably located inside the turret 18. The other end 54 of the plunger 50 is capped by a piston 56 behind which hydraulic fluid may be brought into the cylinder 52 through a hydraulic line 58. It will be appreciated that when the lever is disposed in its first position shown in FIG. 2, with the spring 44 extended and the piston 56 disposed in the left hand end of the cylinder 52, the brake band 34 is held tight about the fixed centerpost 16, with the result that relative rotational movement between the fixed post 16 and the turret 18 will be prevented. On the other hand, when hydraulic fluid is forced through the line 58 from a supply source (not shown), the piston 56 will be pushed from its left hand end of the cylinder 52 to the right hand end thereof, thereby compressing the spring 44 and pivoting the lever 38 about the point 42. When this occurs, the braking system will be in its second position and the brake band 34 will become effectively loosened about the fixed post 16. In such loosened position, the turret may now be drivingly rotated about and relative to the fixed post 16. The admission of hydraulic fluid through the line 58 from the power source (not shown) is ordinarily controlled by an appropriate lever (not shown) operationally set up within the cab 24 of the crane 10.

According to the present invention, the braking system 32 may be provided with an override arrangement, such as is schematically illustrated in FIGS. 5 and 6. Considering first FIG. 5, the conventional braking system hereinabove described is shown schematically on the right hand side of the diagram — if the hydraulic line from the cylinder 52 to the control valve 60 is considered only to comprise the line segment 58, the dotted line segment 58*a*, and the final line segment 58*b*. In adapting this braking system to incorporate the present invention, the dotted line segment 58*a* is eliminated altogether and the hydraulic line between the cylinder 52 and the control valve 60 is modified to comprise the segment 58, the segment 58*c*, the valving arrangement, designated generally as 62, the segment 58*d*, and the segment 58*b*. The valving system 62 comprises two hand control needle valves 64 and 66, one of which, 64, is placed in series with the segments 58*e*, 58*d* of the hydraulic line; and the other 66, which is connected to segment 58*c* through a segment 58*g*. The other side of the valve 66, however, is connected by a segment 58*h* into a double acting valve 68. The valve 68 may be moved between a first position in which the segment 58*h* is connected internally through the valve by a line 68*a* to the hydraulic line segment 58*d*, and a second position wherein not only is the supply of hydraulic fluid which may pass through the segments 58*b*, 58*d*, 68*a*, 58*h*, 58*g*, 58*c* and 58 cut off, but the fluid which is already in the end of 58*a* of the cylinder 52 and the hydraulic line segments 58, 58*c*, 58*g* and 58 is diverted to a dump tank 70. The valve 68, which is normally maintained in its second position by the spring 72, may be shifted to its first position by energization of the solenoid 74.

The schematic diagram of FIG. 6 discloses circuitry whereby the hydraulic control override system and its warning horn 80 may be appropriately set up in accordance with the present invention. Connected to the positive terminal 82 of a 24V direct current power supply 85 through a fuse 86, an off-on switch 87, and a manifold line 110, are a plurality of leads 88, 89, 90, 91, 92 and 93, each of which extends through one or more elements to complete a circuit to the negative terminal 94 of the power supply 85 through a manifold line 95. Thus:

Lead 88 is interrupted by a contact 96 of relay CR-1 in its connection through the coil 97 of the solenoid 74 to the line 95.

Lead 89 is interruptable by limit switch LS-1 and also by contact 98 of relay CR-1 in its circuit through such control relay CR-1, to line 95.

Lead 90 also completes its circuit through control relay CR-1 with the closing of a normally open push button switch PB-1.

Lead 91 passes through two in-series limit switches LS-2, LS-3, a contact 99 operable by a second control relay CR-2, also in the circuit to line 95.

Lead 92 may complete its circuit to line 95 through the control relay CR-2 by the closing of a second push-button switch PB-2.

Lastly, lead 93 is interruptable by the opening of normally closed contact 100 in its connection to one terminal 102 of the warning horn 104, the other terminal being connected through a further lead 108 to line 95 to complete a circuit with the power supply 85.

It should be pointed out with reference to FIG. 5 that if the valve 66 is closed and the valve 64 is left open, the hydraulic override system of the present invention is not placed in effect. On the other hand, when it is desired to make the safety override system effective, the valve 66 is opened and the valve 64 is closed.

When the system is so placed in effect, in the absence of actuation of the solenoid 74, the valve 68 provides a direct 68*a* from line segment 58*h* to the dump tank 70. However, when valve 68 is shifted from its second to its first position, passage 68*a* is cut off and a passage 68*b* is established for communication between the hydraulic line segment 58*h* and the further hydraulic line segment 58*d*. This enables the crane operator through his control 60 in the cab to operate his braking control in the normal manner. However, as soon as the solenoid 74 is de-energized, valve 68 shifts back to passageway 68*a*. The result is that no further supply of hydraulic fluid is passed into the upper end 52*a* of the cylinder 52 and, moreover, the line of communication is re-established between the hydraulic line segment 58*h*, through the valve passageway 68*a*, to the dump tank 70. Fluid theretofore under pressure in the end 52*a* of the cylinder 52 will bleed off, through the line segments 58, 58*c*, 58*g*, and 48*h* and the passageway 68*a*, into the dump tank 70. With pressure no longer being maintained on the piston 56, the spring 44 will immediately cause the brake lever 38 to pivot back to its first brake tightening position shown in FIG. 2, thereupon locking the turret 18 against further rotation and preventing the boom 26 from being swung into the danger arc 144.

The disposition of the three limit switches LS-1, LS-2, and LS-3 and the mechanical means for triggering these switches are illustrated in FIGS. 2, 3, and 4 of the drawings. Each of these three switches may be constituted of a switching box 118 disposed on the inside of a plate 119 which may be mounted on the outside of a housing or on one of the roller bearings 119*a* which support the turret and permit it to be rotated about its vertical axis. An L-shaped arm 120 may extend from each switch LS-1, LS-2, LS-3 through orifices 121 in the plate 119 in the manner best illustrated in FIG. 3. Each arm 120 may be swung from a first switch closed position in which the arm may hang downwardly, as shown for each of the three switches LS-1, LS-2, and LS-3 in FIG. 3, to a second switch-opened position, in which the arm 120 will be rotated a predetermined angle upwardly from its vertical position as shown in FIG. 3. Such rotation will be caused to occur whenever an arm 120 passes and is struck by an upwardly extending striker plate 122. The striker plate 122 may be in the form of a height-adjustable plate secured to an angle 122*a* by a screw or bolt 123 which is disposed to extend upwardly through a slot 124 in an inverted U-shaped channel member 126, and is secured at a selected position in such slot 124 by a nut 128 and aligning pin 129.

The channel member 126 may itself be secured to the annular member 20 on the platform 12 by a further bolt or screw 130 which may extend upwardly from the member 20 and is capped by a further nut 132. To enable the channel members 126 to be placed at any angular disposition 360° about the vertical axis 134 of the fixed centerpost and the surrounding cylindrical turret 18, the circumscribing annular member 20 desirably should have drilled or otherwise provided in it a plurality of threaded orifices 136 which are spaced from each other by the same distance as the spacing between the holes 138 in the channel member 126 through which the hold down bolts 130 may be passed. As an alternative means for mounting the channel member 126, and particularly to provide for greater flexibility in the disposition of such member 126 in relation to the depending switch arms 120, pairs of flat elements 127 having orifices 129 at their ends 131 may be provided, with each pair being fastenable together in any angular relationship, with one free end 131 being secured to the annular plate 12 and the other free end 131 being fastened to an end of the channel member 126.

Figure 7:
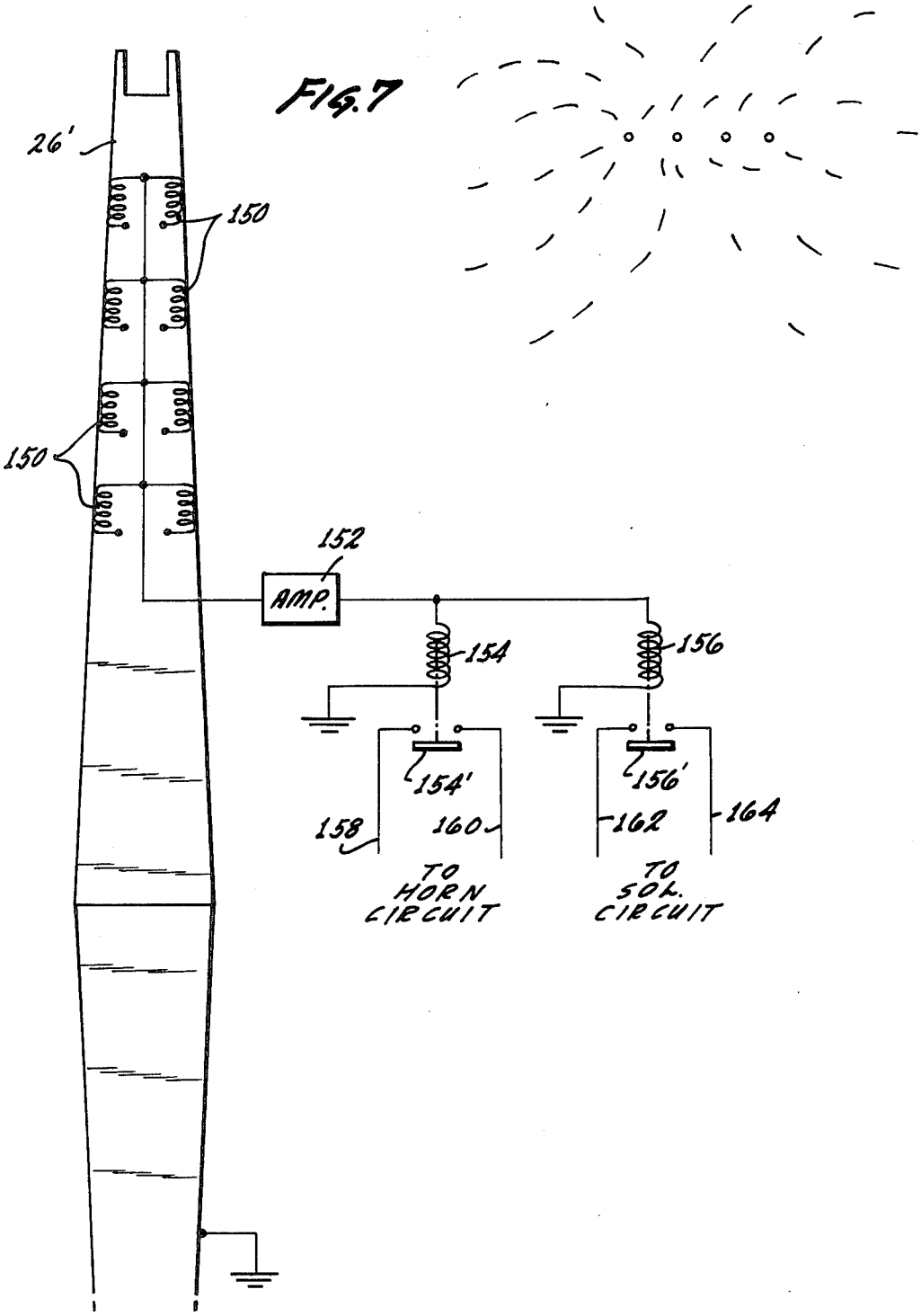
FIG. 7 is a schematic diagram of a magnetic field detecting system disposed in a crane boom.

It is a further feature of the present invention to provide detecting means in the crane boom to detect a predetermined proximity to the high-tension wires 31 and on the basis of such detection, to actuate both the horn and hydraulic override brake system of the type heretofore discussed in connection with the embodiment of FIGS. 1 through 6, inclusive. As schematically shown in FIG. 7, a plurality of pickup coils 150 may be disposed in the crane boom 26' in the manner of an antenna pickup array. This array of coils 150 may be connected to a detector-amplifier 152 with the output of the amplifier being conducted to a pair of solenoid operated switches 154, 156. The solenoid 154 desirably should be actuatable with a lesser current amperage than is required to actuate solenoid 156. Desirably also, the amplifier 152 should be provided with a potentiometer or other regulator (not shown) in conjunction with an output meter to enable the amplifier output to be regulated to provide, at the desired distance from the high-tension lines, just enough signal strength to actuate first, the solenoid 154 and then, with an increase in amperage of the current caused by the crane boom being brought closer to the high-tension lines, the solenoid 156.

In use, the crane 10 is moved into position and its wheels 14 are locked. An outrigger leg (not shown), if provided with the platform 12, would be dropped to the ground and secured. The crane turret 18 may then be very carefully rotated in one direction until the boom is disposed in a position almost as close to the wires or other structure as is still considered safe. This could be then on a radial line 140 (FIG. 2). A channel member 126 is then mounted on the annular member 20, radially outwardly of the plate 119 from which project the L-shaped arms 120 of the three limit switches LS-1, LS-2 and LS-3, and in the positions in which the arms 120 are found to be disposed, and the striker plate projection 122 is so located in the slot 124 that any further rotation of the turret 18 in the same direction will cause the striker plate 122 to strike and rotate upwardly the arm 12 of the switch LS-1, thereby to open this switch. The turret is then rotated in the opposite direction until the boom again arrives at almost the last safe position relative to the wires or other structure. This might be, for example, on the radial line 142. A second channel member 126 is then similarly mounted on the annular member 120 outwardly adjacent the arms 120 of the three limit switches LS-1, LS-2 and LS-3 in that disposition of the turret, and a further striker plate projection 122 will be provided in the slot 124 adjacent the limit switch LS-1.

Contacts 96 and 98 of control relay CR-1, which are closable by relay CR-1, are normally open and are closed only when power is applied to relay CR-1. This will occur by the temporary closure of the normally open switch PB-1 when the latter is pushed by the crane operator. However, once contact 98 is closed, the power circuit through the relay CR-1 is maintained until interrupted by the opening of normally closed limit switch LS-1.

Similarly, normally open contact 99 and normally closed contact 100 of relay CR-2 are reversed by the crane operator's pushing the switch button PB-2 to complete a power circuit through contact relay CR-2; and both contacts 99 and 100 are thereafter maintained in their respective closed and opened positions by relay CR-2 until either of the two normally closed limit switches LS-2, LS-3 is opened, whereupon relay CR-2 is de-energized thereby to reposition the contacts 99, 100 in their respective normally opened and closed positions.

Upon consideration of the FIG. 6 circuit diagram and the foregoing explanation thereof, it will be appreciated that the override limit system according to the present invention may be placed in operation in a crane in which the system has been installed in the following manner: First, the crane operator closes the switch 87, the immediate effect of which is to sound the horn 104 since a circuit is thereby completed to the power supply 85 through the line 110, lead 93, normally closed contact 100, the horn 104, lead 108 and manifold line 95. The operator may, and in most instances will, cut off the sounding horn 104 by pushing and then releasing the button switch PB-2, thereby momentarily closing the circuit through the control relay CR-2, the effect of which is to open normally closed contact 100 in the horn circuit to break the same. Simultaneously, normally open contact 99 is closed by relay CR-2, thereby completing an independent power circuit for the latter relay through the normally closed limit switches LS-2 and LS-3, to maintain relay CR-2 energized, irrespective of the crane operator's releasing the pushbutton switch PB-2. However, should either limit switch LS-2 or LS-3 be opened by projection 122 striking and rotating 90° the arm 120 of either such limit switch, the relay CR-2 will immediately become de-energized thereby both to return contact 99 to its open position, and contact 100 to its normally closed position in which the power circuit to the horn is re-completed to sound the same.

At the time the crane operator pushes the switch PB-1 temporarily closed to cut off the sounding horn 104, he will also be instructed to push and then release the other pushbutton switch PB-1 momentarily to energize the other control relay CR-1. With such energization, the normally opened contact 98 is closed to complete an independent power circuit through the relay CR-1 to maintain its energization after the operator releases the switch PB-1. This circuit, however, is interruptable by opening of the normally closed limit switch LS-1 which is disposed in series in this circuit. Also with the energization of relay CR-1, contact 96 is closed to energize the coil 97 of solenoid 74. The effect of such energization of coil 97 of solenoid 74 is to cause valve 68 (FIG. 5) to move from its normally maintained second position, wherein no hydraulic fluid reaches the brake cylinder 52, so that the brake band 34 is maintained tightly about the post 16 by the spring 44 acting on the lever 38 (FIG. 2), to its first position, wherein hydraulic fluid may be brought from the source of supply to the cylinder 52 in accordance with the crane operator's control 60. Thereby, the lever 38 is pivoted against the force of the spring 44 to loosen the brake band 34 about the post 16 so that the turret may be rotated in accordance with the power drive, as controlled by the crane operator. However, should the crane turret 18 be rotated to an angle where the projection 122 strikes the arm 120 of the limit switch LS-1 to open the same, the immediate effect will be to de-energize the control relay CR-1 and thereby open both contacts 96 and 98. The breaking of the latter contact simply means that relay CR-1 will not further be energized until the pushbutton switch PB-1 is re-pressed by the crane operator; but the breaking of the contact 96 immediately de-energizes solenoid 74, thereby to shift valve 68 back to its second position. In this second position, no further hydraulic fluid reaches cylinder 52 and the fluid under pressure theretofore maintained in the cylinder end 52a behind piston 56 is dumped by the cylinder 52 being placed in communication with the dump tank 70. The spring 44, being then effectively unopposed by the piston 56, moves the lever 38 back to its first brake locking position. The crane operator, then, will find that it will be impossible for him to swing the crane turret 18, and hence the boom 26 carried thereby, within the danger arc of swing 144.

Thus, with the system of the present invention, as soon as a projection 122 strikes a depending arm 120 of one of the two outside limit switches LS-2 or LS-3, in the aligned series of such switches, LS-2, LS-1, LS-3, the horn 80 will sound to warn the cab operator that his turret has almost reached the danger arc of swing 144. If the crane operator nevertheless permits the turret 18 to continue to rotate further in the same direction of rotation to where the projection 122 strikes the depending arm 120 of the limit LS-1 to open the same, the turret 18 becomes locked by its braking system against further rotation in any direction. Desirably, also, the valve 68 may be also be connected with the hydraulic turret rotating drive system so as to simultaneously cut off and dump hydraulic fluid utilized in so rotatingly driving the turret, and thereby further guarantee the complete cessation of further rotation of the turret 18 into the danger arc 144. It should be readily appreciated that the same initial horn warning, and then brake locking of the turret 18, will occur if the turret 18 is rotated in the opposite direction to where the other of the limit switches LS-2, LS-3 is first tripped, and then limit switch LS-1 is tripped, by the projection 122 on the channel 126 provided on the opposite side of the proscribed arc 144.

In applying the further embodiment of the invention illustrated in FIG. 7, either with or without all of the embodiment of FIGS. 1 through 6, when the crane boom 26' is brought as close to the wires 31 as is deemed safe, the coils 150 will be picking up the radio frequency emissions from the conducting high-tension lines 31. These emissions, of course, will be at 60 cycles per second or some harmonic thereof. The R-F emissions picked up by the coils 150 will be conducted to the detector-amplifier 152, the output of which may be, through the detector rectification, a DC voltage. This may be regulated by a potentiometer (not shown) in reference to a meter (also not shown) and the output voltage and/or current should then be set to a sufficient value to actuate both solenoids 154 and 156. The boom may then be swung back away from the power lines 31. With such a setting of the detector control, whenever the boom 26' approaches the wires 31 to the point where the R-F signal is picked up, detected and amplified to reach a first voltage and/or current value, it will actuate solenoid 154 to open its switch 154' and break the horn circuit through leads 158 and 160, in the manner accomplished either by LS-2 or LS-3 in the FIG. 1-6 embodiment. Thereby, the horn warning will be sounded to the crane operator.

Further, as the boom is brought even closer to the high-tension wires 31, the voltage and/or current value at the output of the detector-amplifier 152 will finally reach a point at which it will also actuate the solenoid 156 to open the switch 156'. By connecting the leads 162 and 164 into the circuit in series with LS-1 in FIG. 6, the opening of the switch 156' will also cause de-energization of the solenoid 74 to operate the valve 68, with the consequences hereinabove described when the switch LS-1 in FIG. 6 is opened.

From the foregoing description, it may be seen that the present invention may readily be adapted for use with existing cranes to provide means to prevent the crane turret, and the boom carried thereby, from swinging into a danger arc-of-swing, such as too close to high-tension lines or other structures in the vicinity of which the crane is operating, but with which the crane boom is not to come into contact. The system of the present invention, moreover, includes built-in safety features, such that the desired swing limitation will result should any failure, such as power, wire break, etc. occur in the mechanical or electrical components, as well as when the system is operating normally.

We claim:

1. Means to warn a crane operator of his attaining the limit of a permissible angular rotation of the rotatable turrent of the crane on the platform on which the turret of the crane is carried; said means comprising:

a. electrically operable alarm device;

b. a source of electric current;

c. an electrically operated relay, said relay being connectable to said source of electric current and having a first contact in circuit with said source of electric current and said warning means and said contact being normally closed to actuate the warning means; said relay having a second contact in circuit with said source of electric current and with the energizing coil of said relay and normally maintained in open circuit breaking position; said relay, when actuated, opening the first contact and closing the second contact; first switching means disposed peripherally on the crane turret to rotate therewith, said first switching means being in series with said second contact and being switched to and maintained in its "on" position, said first switching means when switched to its "off" position serving to open the relay circuit and thereby close the said first contact to operate said warning device;

d. second switching means serving momentarily to connect said source of current to said relay to actuate and the latter; and thereby open the first contact and close the second contact;

e. projecting means to operate said first switching means, said projecting means being disposable fixedly adjacent the periphery of said crane turrent and at least one predetermined point on, and within the arc of swing of said first switching means on said crane turret, whereby, when said turret is rotated to cause said first switching means to pass and strike said projecting means, said first switching means will be switched from its "on" position to its "off" position, thereby breaking the relay circuit with said power source to de-energize said relay, and cause said second contact to close and operate said warning device.

2. In a braking system having a solenoid operatively associated with the braking mechanism in such a manner that braking is effected unless the coil of said solenoid is energized by being connected to a source of electric power, circuit means selectively to connect said solenoid to said electric source, said circuit means comprising:

relay means, said relay means having an actuating coil and first and second contacts both of which are normally open, but are closed when the relay of said coil is energized by being connected to said source of electric power;

a limit switch, said limit switch having a projecting tripping element and said limit switch normally being closed to pass current therethrough unless said projecting tripping element is displaced; and a temporarily closable switch, said temporarily closable switch having a closing member urged from its closed position but displaceable by manual force to such closed position, and said temporarily closable switch, when not so closed by said member being so displaced, being "open", so that no current may pass therethrough until said closing member is displaced to close said temporarily closable switch, one extremity of said relay coil being connected to one terminal of said power source, and the other extremity of said coil being connected to the other terminal of said power source through a series circuit comprising the first contact of said relay means and said limit switch, and through an alternate circuit comprising said temporarily closable switch; the second contact of said relay means being interposed between one terminal of said solenoid coil and said source of electric power;

whereby the brake in said braking system is maintained in braking effect until the member of the temporary closable switch is manually forced into the switch closing position, thereupon to complete a temporary connection of the coil of the relay means to the power source to actuate said relay; and upon such actuation, said relay closes both its first and second contacts with the first contact serving to complete the alternate circuit from the power source through the limit switch to the one extremity of the relay coil to maintain said relay coil in energizing position so long as said limit switch remains in its normally closed position; and the second contact of said relay means, when so closed, completing a power circuit to the coil of said solenoid, thereby operating said solenoid to release the braking mechanism; but said braking mechanism re-effecting braking whenever said projecting yripping element of said limit switch is displaced, thereby to open said limit switch and disconnect the coil of said relay means from said power source to de-energize said relay means and open both said first and second contacts, the opening of said contact breaking the power circuit to the coil of said solenoid.

3. An electrically operated warning system, said system comprising:

a. an electrically operated warning device;

b. a source of electric current;

c. relay means, said relay means having first and second contacts, said first contact being closed and said second contact normally being open when the coil of said relay means is unenergized by connection to such source of electric current, the disposition of both said contacts being reversed upon the energization of the coil of said relay means; and one end of the coil of said relay means being connected to one terminal of said source of electric power;

d. at least one limit switch; and e. a temporarily closable switch, said temporarily closable switch having a switch closing member urged from its closed position but displaceable by manual force to said closed position, and said temporarily closable switch, when not so closed by said member, being open so that no current may pass therethrough unless said closing member is displaced temporarily to close said temporarily closable switch;

the other end of the coil of said relay means being connected to the other terminal of said power source through a series circuit comprising the second contact of said relay means and said limit switch and through an alternate circuit comprising said temporarily closable switch;

the first contact of said relay means being interposed between one terminal of said warning device and said source of electric power, the other terminal of said warning device being connected to said source of electric power, whereby said warning device will be activated until said closing member of said temporarily closable switch is displaced by manual force to the closed position of said switch, thereby temporarily completing the alternate circuit between the other end of the coil of the relay means and the other terminal of the power source to energize the coil of the relay means and reverse the closed and open dispositions respectively of said first and second contacts, the opening of the first contact causing said warning device to become deactivated, and the closing of the second contact serving to complete a circuit between the other end of said coil of said relay means to the power source through said limit switch, and to maintain such energization until the projecting tripping element of said limit switch is displaced to open said limit switch and thereupon break the circuit between said other terminal of the power source and the other end of the coil of said relay means, and thereby de-energize the same, whereupon the first contact of said relay means is reclosed to activate said warning device.

4. A warning and braking system, said system comprising and electrically operated warning system as described in claim 3, and circuit means in a braking system having a solenoid operatively associated with the braking mechanism in such a manner that braking is effected unless the coil of said solenoid is energized by being connected to a source of electric power, said circuit means selectively connecting said solenoid to said source of electric power and said circuit means comprising:

a. relay means, said relay means having an actuating coil and first and second contacts both of which are normally open, but are closed when the relay of said coil is energized by being connected to said source of electrical powers;

b. a limit switch, said limit switch having a projecting tripping element and said limit switch normally being closed to pass current therethrough unless said projecting tripping element is displaced; and c. a temporarily closable switch, said temporarily closeable switch having a closing member urged from its closed position, but displaceable by manual force to such closed position, and said temporarily closable switch, when not so closed by said member being so displaced, being "open" so that no current may pass therethrough until said closing member is displaced to close said temporarily closeable switch;

one extremity of said relay coil being connected to one terminal of said power source, and the other extremity of said coil being connected to the other terminal said power source through a series circuit comprising the first contact of said relay means and said limit switch, and through an alternate circuit comprising said temporarily closeable switch; the second contact of said relay means being interposed between one terminal of said solenoid coil and said source of electric power;

the projecting tripping element of the warning system limit switch being disposed in such a directional relationship to the projecting tripping element of the warning system limit switch being disposed in such a directional relationship to the projecting tripping element of the limit switch of the braking system circuit means, that the projecting tripping element of the first said limit switch is displaced before the projecting tripping element of the second said limit switch is displaced, as the apparatus in which the braking system is incorporated moves toward an undesired position, so that the warning device is first actuated and, as the apparatus moves further toward the undesired position, breaking to prevent such further movement is applied.

5. Means to limit the angular rotation of the rotatable turret of a crane about a cylindrical post fixedly mounted on the platform on which the turret of the crane is carried, to prevent the crane boom from too closely approaching high-tension wires or other structure, wherein the crane turret is provided with a brake band circumscribing said post, said brake band being urged by spring means into a first position in which said brake is tightened about said post to block relative rotation between said turret and said cylinder, said brake band being releasable by action of a piston in a hydraulic cylinder, in opposition to the urging of said spring, moving said spring into a second position wherein said brake band is sufficiently loosened about said post to permit such relative rotation, the action of said piston in said cylinder being manually controllable by operating control means located in the crane cab, said control means being operable either to permit fluid under pressure from a source of supply thereof to be conducted to said cylinder to drive the piston therein, or alternatively, to cut off the supply of said fluid to said cylinder and to cause the fluid under pressure in said cylinder to be discharged therefrom, said limiting means comprising:

a. override valve means, said valve means being interposable between the supply of fluid under pressure and said hydraulic cylinder, said value means being shiftable between a first position wherein communication is maintained through said control means between said supply of fluid under pressure and said cylinder, and a second position wherein such communication is cut off and the fluid in the cylinder is discharged therefrom;

b. a solenoid operatively associated with said valve means, said solenoid, when actuated by an electric current being conducted through the coil of said solenoid, serving to shift said valve means from its said second position to its said first position;

c. a source of electric current connectable to said solenoid to actuate the same;

d. switching means disposed peripherally about the crane turret to rotate therewith, said switching means being switched to and maintained in an "on" position, and said switching means when so switched to its "on" position, serving to connect said source of current to the coil of said solenoid to actuate the latter, said switching means including an arm which, when struck by an inwardly projecting element, turns the switching means from its "on" position to its "off" position; and e. projecting means to operate said switching means to swtich it from its "on" position to its "off" position; said projecting means being disposable fixedly adjacent the periphery of said crane turret and at a predetermined point on and within the arc of swing of said switching means on said crane turret, said projecting means comprising a threaded element passed upwardly through a slot in an elongated channel member and held at a predetermined position in said slot by a nut; and said channel member being securable on said platform at predetermined positions circumscribing said turret and spaced from each other by the length of said slot, by means of removable fastners extending downwardly into orifices in said platform whereby said upwardly projecting threaded element may be disposed securely at any point in a complete circle circumscribing said turret to trigger said switching means, whereby when said turret is rotated to cause said switching means to pass and strike said projecting means, said switching means will be switched from its "on" position to its "off" position, thereby causing said solenoid to cease maintaining said valve means in its first position and to shift said valve means from its said first position and to its said second position, with the result that said brake band is urged back by its spring to its first position of tightening about said post, to prevent further relative rotation between said turret and said fixed post.

6. Means to limit the angular rotation of the rotatable turret of a crane about a cylindrical post fixedly mounted on the platform on which the turret of the crane is carried, to prevent the crane boom from to closely approaching high-tension wires or other structure, wherein the crane turret is provided with a brake band circumscribing said post, said brake band being urged by spring means into a first position in which said brake band is tightened about said post to block relative rotation between said turret and said cylinder, said brake band being releasable by action of a piston in a hydraulic cylinder, in opposition to the urging of said spring, moving said spring into a second position wherein said brake band is sufficiently loosened about said post to permit such relative rotation, the action of said piston in said cylinder being manually controllable by operating control means located in the crane cab, said control means being operable either to permit fluid under pressure from a source of supply thereof to be conducted to said cylinder to drive the piston therein, or alternatively, to cut off the supply of said fluid to said cylinder and to cause the fluid under pressure in said cylinder to be discharged therefrom, said limiting means comprising:

a. override valve means, said valve means being interposable between the supply of fluid under pressure and said hydraulic cylinder, said valve means being shiftable between a first position wherein communication is maintained through said control means between said supply of fluid under pressure and said cylinder, and a second position wherein such communication is cut off and the fluid in the cylinder is discharged therefrom;

b. a solenoid operatively associated with said valve means, said solenoid, when actuated by an electric current being conducted through the coil of said solenoid, serving to shift said valve means from its said second position to its said first position;

c. a source of electric current connectable to said solenoid to actuate the same;

d. switching means disposed peripherally about the crane turret to rotate therewith, said switching means being switched to and maintained in an "on" position, and said switching means when so switched to its "on" position, serving to connect said source of current to the coil of said solenoid to actuate the latter, said switching means including an arm which, when struck by an upwardly projecting element, turns the switching means from its "on" position to its "off" position; and e. projecting means to operate said switching means to switch it from its "on" position to its "off" position; said projecting means being disposable fixedly adjacent the periphery of said crane turret and at a predetermined point on and within the arc of swing of said switching means on said crane turret, said projecting means comprising a threaded element passed upwardly through a slot in an elongated channel member and held at a predetermined position in said slot by a nut, and said channel member being securable on said platform about the arc of swing of said turret, whereby when said turret is rotated to cause said switching means to pass and stike said projecting means, said switching means will be switched from its "on" position to its "off" position, thereby causing said solenoid to cease maintaining said valve means in its first postition and to shift said valve means from its said first position to its said second position, with the result that said brake band is urged back by its spring to its first position of tightening about said post, to prevent further relative rotation between said turret and said fixed post.

7. Means to limit the angular rotation of the rotatable turret of a crane about a cylindrical post fixedly mounted on the platform on which the turret of the crane is carried, to prevent the crane boom from too closely approaching high-tension wires or other structure, wherein the crane turret is provided with a brake band circumscribing said post, said brake band being urged by spring means into a first position in which said brake band is tightened about said post to block relative rotation between said turret and said cylinder, said brake band being releaseable by action of a piston in a hydraulic cylinder, in opposition to the urging of said spring, moving said spring into a second position wherein said brake band is sufficiently loosened about said post to permit such relative rotation, the action of said piston in said cylinder being manually controllable by operating control means located in the crane cab, said control means being operable either to permit fluid under pressure from a source of supply thereof to be conducted to said cylinder to drive the piston therein, or alternatively, to cut off the supply of said fluid to said cylinder and to cause the fluid under pressure in said cylinder to be discharged therefrom, said limiting means comprising;

a. override valve means, said valve means being interposable between the supply of fluid under pressure and said hydraulic cylinder, said valve means being shiftable between a first position wherein communication is maintained through said control means between said supply of fluid under pressure and said cylinder, and a second position wherein such communication is cut off and the fluid in the cylinder is discharged therefrom;

b. a solenoid operatively associated with said valve means, said solenoid, when actuated by an electric current being conducted through the coil of said solenoid, serving to shift said valve means from its said second position to its said first position;

c. a source of electric current connectable to said solenoid to actuate the same;

d. switching means disposed peripherally about the crane turret to rotate therewith, said switching means being switched to and maintained in an "on" position, and said switching means when so switched to its "on" position, serving to connect said source of current to the coil of said solenoid to actuate the latter;

e. projecting means to operate said switching means to switch it from its "on" positon to its "off" position; said projecting means being disposable fixedly adjacent the periphery of said crane turret and a predetermined point on and within the arc of swing of said switching means on said crane turret, whereby when said turret is rotated to cause said switching means to pass and strike said projecting means, said switching means will be switched from its "on" position to its "off" position, thereby causing said solenoid to cease maintaining said valve means in its first position and to shift said valve means from its said first position to its said second position, with the result that said brake band is urged back by its spring to its first position of tightening about said post, to prevent further relative rotation between said turret and said fixed post; and f. additional valve means and conduits whereby said override valve means may, at the option of the crane operator, either be bypassed all together to permit the hydraulic braking system of the turret to be controlled entirely by the crane operator, or interposed between the hydraulic cylinder and, through the operators manual control means, the supply of pressure fluid, to provide a safety override valve control.

8. Means to limit the angular rotation of the rotatable turret of a crane about a cylindrical post fixedly mounted on the platform on which the turret of the crane is carried, to prevent the crane boom from too closely approaching high-tension wires or other structure, wherein the crane turret is provided with a brake band circumscribing said post, said brake band being urged by spring means into a first position in which said brake band is tightened about said post to block relative rotation between said turret and said cylinder, said brake band being releasable by action of a piston in a hydraulic cylinder, in opposition to the urging of said spring, moving said spring into a second position wherein said brake band is sufficiently loosened about said post to permit such relative rotation, the action of said piston in said cylinder being manually controllable by operating control means located in the crane cab, said control means being operable either to permit fluid under pressure from a source of supply thereof to be conducted to said cylinder to drive the piston therein, or alternatively, to cut off the supply of said fluid to said cylinder and to cause the fluid under pressure in said cylinder to be discharged therefrom, said limiting means comprising:

a. override valve means, said valve means being interposable between the supply of fluid under pressure and said hydraulic cylinder, said valve means being shiftable between a first position wherein communication is maintained through said control means between said supply of fluid under pressure and said cylinder, and a second position wherein such communication is cut off and the fluid in the cylinder is discharged therefrom;

b. a solenoid operatively associated with said valve means, said solenoid, when actuated by an electric current being conducted through the coil of said solenoid, serving to shift said valve means from its said second position to its said first position;

c. a source of electric current connectable to said solenoid to actuate the same;

d. switching means disposed peripherally about the crane turret to rotate therewith, said switching means being switched to and maintained in an "on" position, and said switching means when so switched to its "on" positon, serving to connect said source of current to the coil of said solenoid to actuate the latter; and e. projecting means to opearte said switching means to switch it from its "on" position to its "off" position; said projecting means being disposable fixedly adjacent the periphery of said crane turret and at a predetermined point on and within the arc of swing of said switching means on said crane turret, said projecting means comprising member, said channel member being secured adjacent the periphery of the crane turret and within the arch of swing of said switching on said crane turret, said channel member being slotted for at least a substantial part of its length and having fastner means projecting through said slotting and fixedly securable at any predetermined point along the length of said slotting, whereby when said turret is rotated to cause said switching means to pass and strike said projecting means, said switching means will be switched from its "on" position to its "off" position, thereby causing said solenoid to cease maintaining said valve means in its first position and to shift said valve means from its said first position to its said second position, with the result that said brake band is urged back by its spring to its first position of tightening about said post, to prevent further relative rotation between said turret and said fixed post.

9. The means to limit the angular rotation of the rotatable turret of the crane as described in claim 8, wherein articulated means are provided to extend from each extremity of said channel member and pivotably securable thereto, the opposite end of each of said articulated means being pivotably securable to the platform in the vicinity of the periphery of the crane turret, whereby said channel member may be most effectively disposed within the arc of swing of said switching means on said crane turret in order to operate said switching means.

10. A warning and braking system comprising;

a. means to limit the angular rotation of the rotatable turret of a crane about a cylindrical post fixedly mounted on the platform on which the turret of the crane is carried, to prevent the crane boom from too closely approaching high-tension wires or other stucture, wherein the crane turret is provided with a brake band circumscribing said post, said brake band being urged by spring means into a first position in which said brake band is tightened about said post to block relative rotation between said turret and said cylinder, said brake band being releasable by action of a piston in a hydraulic cylinder, in opposition to the urging of said spring, moving said spring into a second position wherein said brake band is sufficiently loosened about said post to permit such relative rotation, the action of said piston in said cylinder being manually controllable by operating control means located in the crane cab, said control means being operable either to permit fluid under pressure from a source of supply thereof to be conducted to said cylinder to drive the piston therein, or alternatively, to cut off the supply of said fluid to said cylinder and to cause the fluid under pressure in said cylinder to be discharged therefrom, said limiting means comprising;

i. override valve means, said valve means being interposable between the supply of fluid under pressure and said hydraulic cylinder, said valve means being shiftable between a first position wherein communication is maintained through said control means between said supply of fluid under pressure and said cylinder, and a second position wherein such communciation is cut off and the fluid in the cylinder is discharged therefrom;

ii. a solenoid operatively associated with said valve means, said solenoid, when actuated by an electric current being conducted through the coil of said solenoid, serving to shift said valve means from its said second position to its said first position;

iii. a source of electric current connectable to said solenoid to actuate the same;

iv. switching means disposed peripherally about the crane turret to rotate therewith, said switching means being switched to and maintained in an "on" position, and said switching means when so switched to its "on" position, serving to connect said source of current to the coil of said solenoid to actuate the latter;

v. projecting means to operate said switching means to switch it from its "on" position to its "off" position; said projecting means being disposable fixedly adjacent the periphery of said crane turret and at a predetermined point on and within the arc of swing of said switching means on said crane turret, whereby when said turret is rotated to cause said switching means to pass and strike said projecting means, said switching means will be switched from its "on" position to its "off" position, thereby causing said solenoid to cease maintaining said valve means in its first position and to shift said valve means from its said first position to its said second position, with the result that said brake band is urged back by its spring to its first position of tightening about said post, to prevent further relative rotation between said turret and said fixed post; and b. means to warn a crane operator of his attaining the limit of a permissable angular rotation of said rotatable turret of the crane on the platform on which said turret of the crane is carried, said means comprising;

i. an electrically operable alarm device;

ii. a source of electrical current;

iii. an electrically operated relay, said relay being connectable to said source of electrical current and having a first contact in circuit with said source of electric current and said alarm device and said contact being noramlly closed to activate the alarm device; said relay having a second contact and circuit with the source of electric current and with the energizing coil of said relay and normally maintained in open circuit breaking position; said relay, when actuated, opening the first contact and closing the second contact; said switching means being in series with said second contact and, when switched to its "off" position, serving to open the relay circuit and thereby close the said first contact to operate said alarm device;

iv. second switching means serving momentarily to connect said source of electric current to said relay to actuate the latter, and thereby open the first contact and close the second contact;

v. said projecting means when passed and struck by the switching means serving to switch the latter switching means from its "on" position to its "off" position, thereby breaking the relay circuit with said source to electric power to denergize said relay, and cause said second contact to close and operate said alarm device.

* * * * *